US010753673B2

(12) United States Patent
Sert et al.

(10) Patent No.: US 10,753,673 B2
(45) Date of Patent: Aug. 25, 2020

(54) WATER TANK ASSEMBLY FOR USE IN A REFRIGERATOR

(71) Applicant: ARCELIK ANONIM SIRKETI, Istanbul (TR)

(72) Inventors: Ahmet Sert, Istanbul (TR); Ali Gokhan Genc, Istanbul (TR); Akin Ozdemir, Istanbul (TR); Burhan Sahin, Istanbul (TR); Mehmet Yasar, Istanbul (TR)

(73) Assignee: ARCELIK ANONIM SIRKETI, Istanbul (TR)

( * ) Notice: Subject to any disclaimer, the term of this patent is extended or adjusted under 35 U.S.C. 154(b) by 156 days.

(21) Appl. No.: 15/766,337

(22) PCT Filed: Oct. 8, 2015

(86) PCT No.: PCT/EP2015/073230
§ 371 (c)(1),
(2) Date: Apr. 5, 2018

(87) PCT Pub. No.: WO2017/059915
PCT Pub. Date: Apr. 13, 2017

(65) Prior Publication Data

US 2018/0313601 A1 Nov. 1, 2018

(51) Int. Cl.
*F25D 23/12* (2006.01)
*F25C 1/25* (2018.01)
*F25D 25/02* (2006.01)

(52) U.S. Cl.
CPC ..... *F25D 23/126* (2013.01); *F25C 1/25* (2018.01); *F25D 25/025* (2013.01); *F25D 2323/122* (2013.01)

(58) Field of Classification Search
CPC ..... F25D 23/126; F25D 25/025; F25D 2323/122; F25D 23/021; F25D 31/002; F25D 25/021; F25C 1/25; B01D 35/027
See application file for complete search history.

(56) References Cited

U.S. PATENT DOCUMENTS 2,468,662 A * 4/1949 Glendening ..... A47B 11/00 312/302
4,909,039 A 3/1990 Yamada et al.
(Continued)

FOREIGN PATENT DOCUMENTS

EP 1832823 A2 9/2007
WO 2010099467 A2 9/2010

OTHER PUBLICATIONS

International search report and written opinion, dated Sep. 2, 2016, of International Application No. PCT/EP2015/073230; 13 pgs.

*Primary Examiner* — Frantz F Jules
*Assistant Examiner* — Martha Tadesse
(74) *Attorney, Agent, or Firm* — Kilpatrick Townsend & Stockton LLP

(57) ABSTRACT

The present invention relates a water tank assembly for use in a refrigerator comprising a compartment for fresh food, a water dispenser and/or an ice making apparatus, two side by side extendable drawers in the compartment, a lower plate underside of the extendable drawers and two outer guiding members for slidably supporting the extendable drawers respectively from their outer sides. The water tank assembly comprises a water tank. The water tank assembly of the present invention further comprises a casing for installation between the extendable drawers and onto the lower plate, wherein the water tank is disposed into the casing.

11 Claims, 10 Drawing Sheets

(56) References Cited

U.S. PATENT DOCUMENTS

Figure 1:
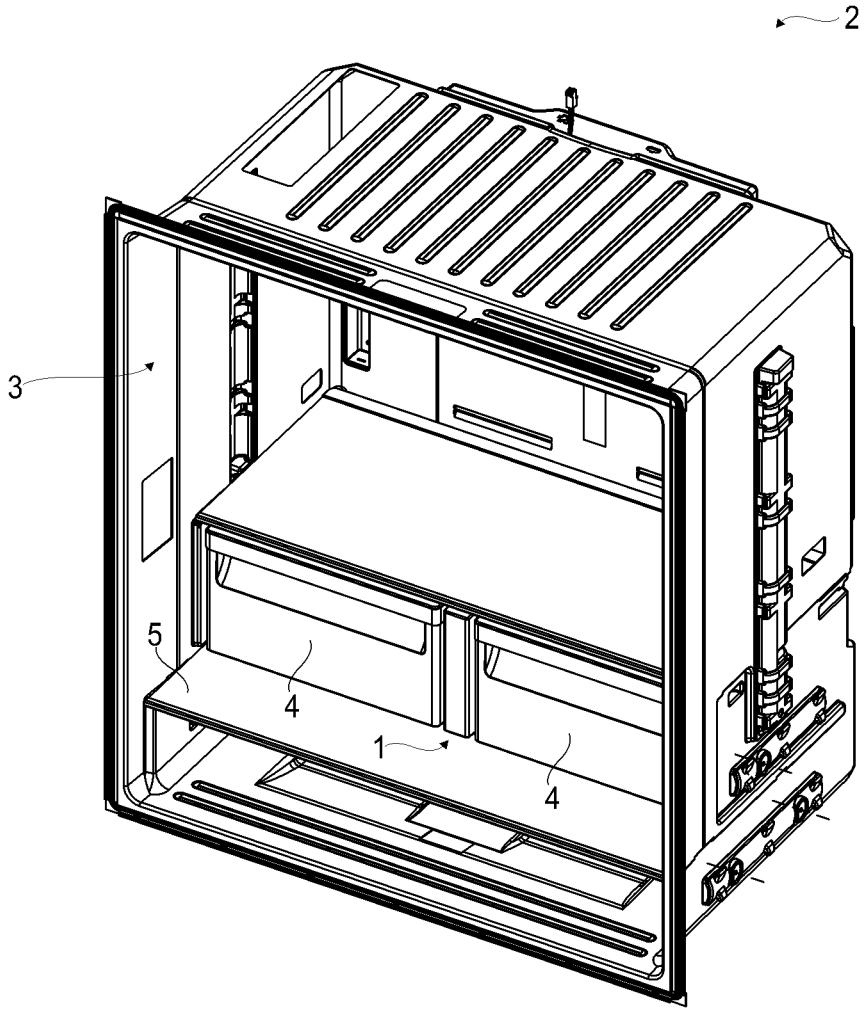

| | | | | |
|---|---|---|---|---|
| 9,243,840 | B1 * | 1/2016 | Kelly | F25D 25/025 |
| 9,939,193 | B2 * | 4/2018 | Kendall | F25D 27/00 |
| 10,107,546 | B2 * | 10/2018 | Lee | B01F 3/04808 |
| 10,240,857 | B2 * | 3/2019 | Yu | F25D 23/00 |
| 2007/0204644 | A1 * | 9/2007 | Braun | F25C 5/187 62/344 |
| 2009/0320509 | A1 * | 12/2009 | Gorz | F25D 21/04 62/264 |
| 2010/0229592 | A1 * | 9/2010 | Lim | F25D 23/126 62/389 |
| 2010/0275633 | A1 * | 11/2010 | An | C02F 9/005 62/318 |
| 2012/0043874 | A1 * | 2/2012 | Simpson | F25D 23/067 312/408 |
| 2014/0265808 | A1 * | 9/2014 | Kendall | F25D 27/00 312/408 |
| 2015/0096323 | A1 | 4/2015 | Lim et al. | |

* cited by examiner

WATER TANK ASSEMBLY FOR USE IN A REFRIGERATOR

RELATED APPLICATIONS

This application is a U.S. National Phase of International Application No. PCT/EP2015/073230, filed Oct. 8, 2015, the entire disclosure of which is incorporated by reference herein.

The present invention relates to a refrigerator. The present invention more particularly relates to the water tank assembly which replenishes the water dispenser or the ice making apparatus of the refrigerator.

Domestic refrigerators are commonly known in the art. In order to improve the user convenience, a domestic refrigerator is commonly provided with an ice making apparatus or a water dispenser which is replenished by the water tank that is located inside the fresh food compartment.

U.S. Pat. No. 4,909,039 (A) discloses a refrigerator which has a water tank that replenishes the ice making apparatus with water.

A common problem with the prior art refrigerator is that the utilizable space of the refrigerator becomes much smaller through the provision of the water tank and the water dispenser or the ice making apparatus, and thus the user's expectations cannot be exactly met. Another common problem with the prior art refrigerator is that the production and assembly of the refrigerator becomes increasingly more complicated and cost-intensive as the functions of the refrigerator is increased through the provision of the water dispenser and the ice making apparatus.

An objective of the present invention is to provide a water tank assembly for use in a refrigerator which overcomes the aforementioned problems of the prior art in a cost-effective way and which enables an improved production and an improved assembly and also an improved efficiency of the space utilization.

This objective has been achieved by the water tank assembly as defined in claim 1, and the refrigerator as defined in claim 9. Further achievements have been attained by the subject-matters respectively defined in the dependent claims.

The refrigerator of the present invention comprises two or more extendable drawers which are disposed side by side into the fresh food compartment; a lower plate which is arranged underside of the extendable drawers; a first set of two outer guiding members which are adapted to slidably support the extendable drawers respectively from their outer sides; a pair of fastening means each adapted to detachably attach one outer guiding member to the respective side wall of the compartment. In the refrigerator of the present invention, the region that is located in between two adjacent extendable drawers and above the lower plate is adapted for the installation of the water tank assembly of the present invention.

The water tank assembly of the present invention comprises a casing which is adapted for the installation into the region in between two adjacent extendable drawers and onto the lower plate, wherein the water tank is disposed into the casing; a second set of two inner guiding members which are adapted to slidably support the extendable drawers respectively from their inner sides and a pair of first attachment means each adapted to detachably attach one inner guiding member to the respective side of the casing.

A major advantageous effect of the present invention is that the space utilization in the refrigerator has been improved by way of installing the water tank assembly into the region in between the extendable drawers and onto the lower plate. Thereby, the dead space between the extendable drawers has been effectively exploited. Another major advantageous effect of the present invention is that the functionality of the water tank assembly has been improved by way of adapting the casing so as to bear the adjacent extendable drawers. Another major advantageous effect of the present invention is that the outer/inner guiding members of the extendable drawers can be more flexibly used. In particular, the outer/inner guiding members can be selectively attached to the side walls of the compartment or to the left/right side sections of the casing during the assembly. Thereby, the production and assembly costs can be further reduced.

In alternative embodiments, the first attachment means of the water tank assembly comprises a releasable form-fitting connection and/or a releasable force-fitting connection. These embodiments are particularly advantageous as the inner guiding members can be easily assembled with the casing of the water tank assembly. Thereby also the existing refrigerators can be retrofitted with the water tank assembly of the present invention.

In another embodiment, the inner guiding members are accommodated in the inner recesses that are formed into the left/right side sections of the casing respectively. These embodiments are particularly advantageous as the width of the water tank assembly can be decreased, and thus the space utilization can be further improved.

In another embodiment, the water tank is accommodated in the cavity that is formed into the casing at a position above both inner recesses for the inner guiding members. This embodiment is particularly advantageous as the width of the water tank assembly can be even further decreased, and thus the space utilization can be still further improved.

In other alternative embodiments, the casing has a two-piece structure which sandwiches the water tank through a second attachment means. These embodiments are particularly advantageous as the left side section and the right side section of the casing can be easily assembled with the water tank.

In other alternative embodiments, the second attachment means comprises a releasable form-fitting connection and/or a releasable force-fitting connection. These embodiments are particularly advantageous as the water tank can be easily released in case of maintenance.

In other alternative embodiments, the casing is detachably attachable to the lower plate and/or the rear wall of the compartment through a third attachment means. These embodiment are particularly advantageous as the casing can be more securely installed into the compartment.

In other alternative embodiments, the third attachment means comprises a releasable form-fitting connection and/or a releasable force-fitting connection. These embodiments are particularly advantageous as the casing can be easily released in case of maintenance.

In another embodiment, the front of the casing is concealed by a decorative cover through a fourth attachment means. This embodiment is particularly advantageous as the decorative cover improves the mechanical strength of the water tank assembly as well as the outer appearance without compromising the width of the water tank assembly.

In other alternative embodiments, the fourth attachment means comprises a releasable form-fitting connection and/or a releasable force-fitting connection. These embodiments are particularly advantageous as the decorative cover can be easily released in case of maintenance.

In another embodiment, the adjacent extendable drawers are illuminated through an illuminating device that is disposed onto the casing of the water tank assembly. This embodiment is particularly advantageous as the usability and functionality of the refrigerator has been improved. Thereby, the user satisfaction can be increased.

In another embodiment, the water tank assembly is connectable to the mains. This embodiment is particularly advantageous as the water tank can be constantly filled. Alternatively, the water tank can be filled through a user accessible openable/closable aperture.

In another embodiment, the outer guiding members are accommodated into two outer recesses that are formed into the opposite sides of the inner lining of the compartment. This embodiment is particularly advantageous as the space utilization can be still further improved.

In other alternative embodiments, the fastening means of the refrigerator comprises a releasable form-fitting connection and/or a releasable force-fitting connection. This embodiment is particularly advantageous as the outer guiding members can be easily released from the inner lining in case of maintenance.

In another embodiment, the extendable drawers are covered through a shelf that is releasably disposed into the compartment. This embodiment is particularly advantageous as the usability and functionality of the refrigerator has been improved.

Figure 2:
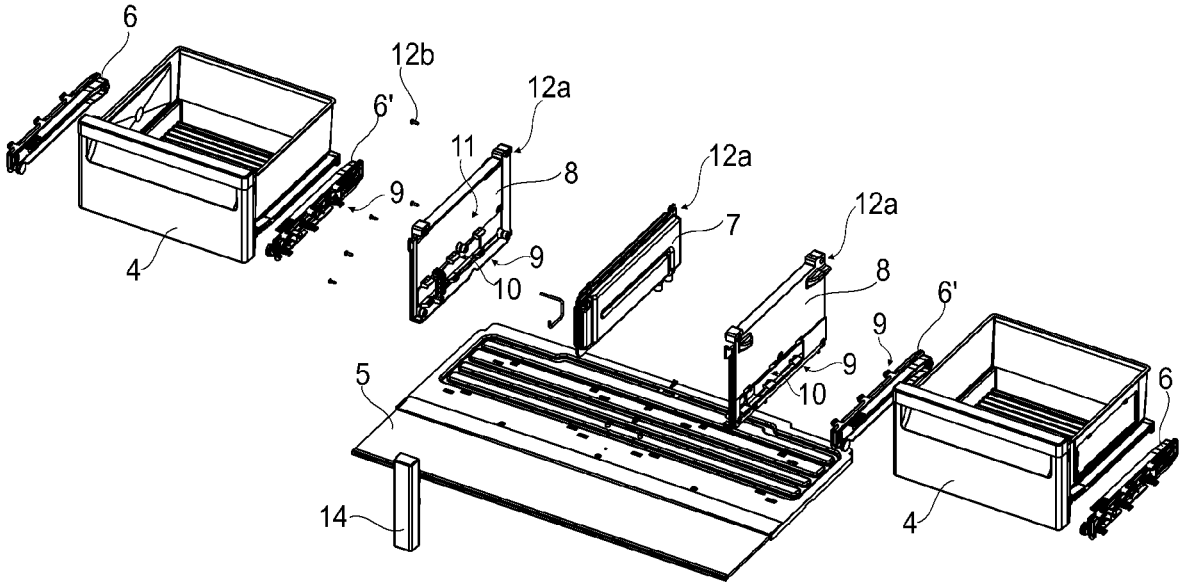
Figure 3:
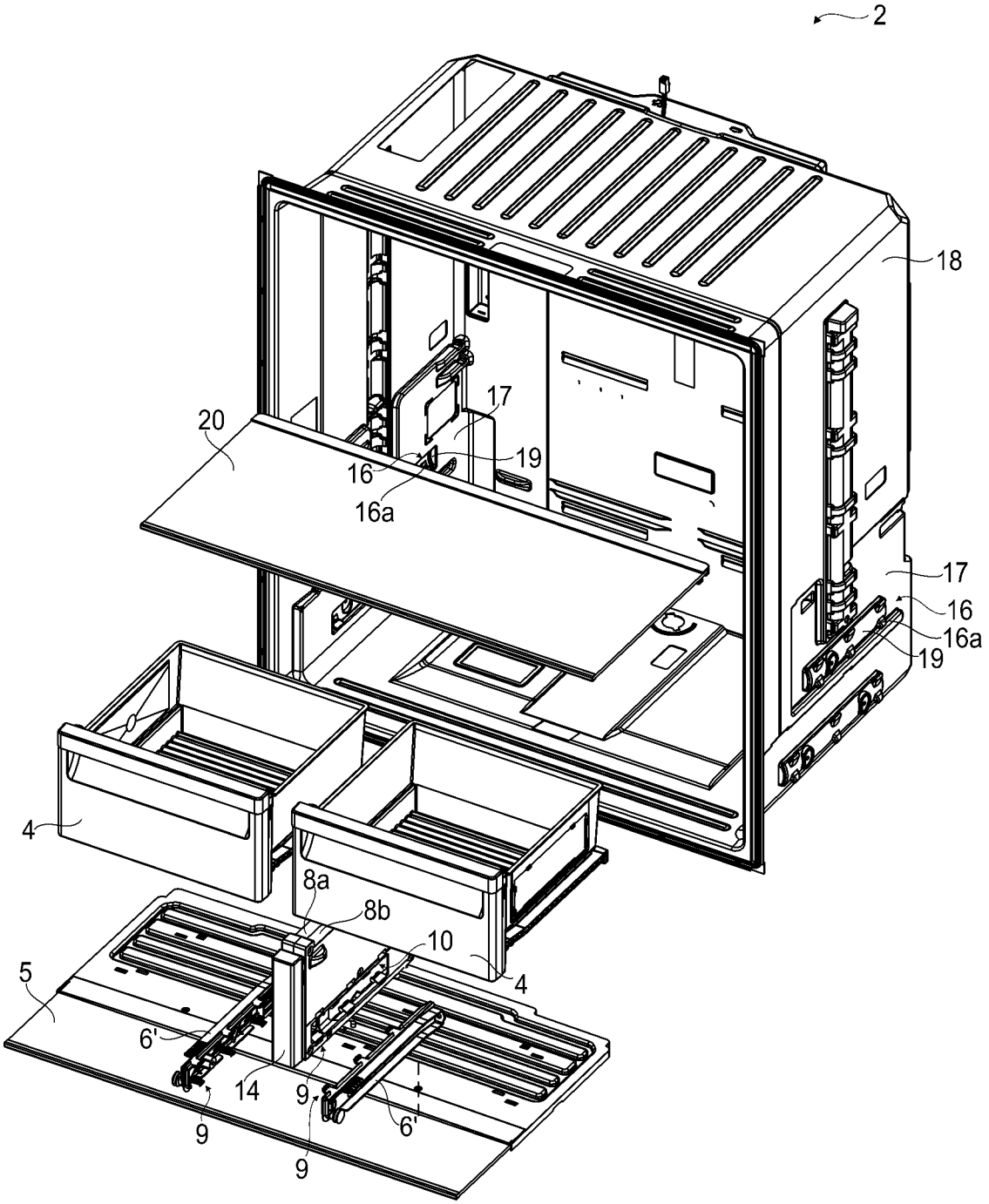
Figure 4:
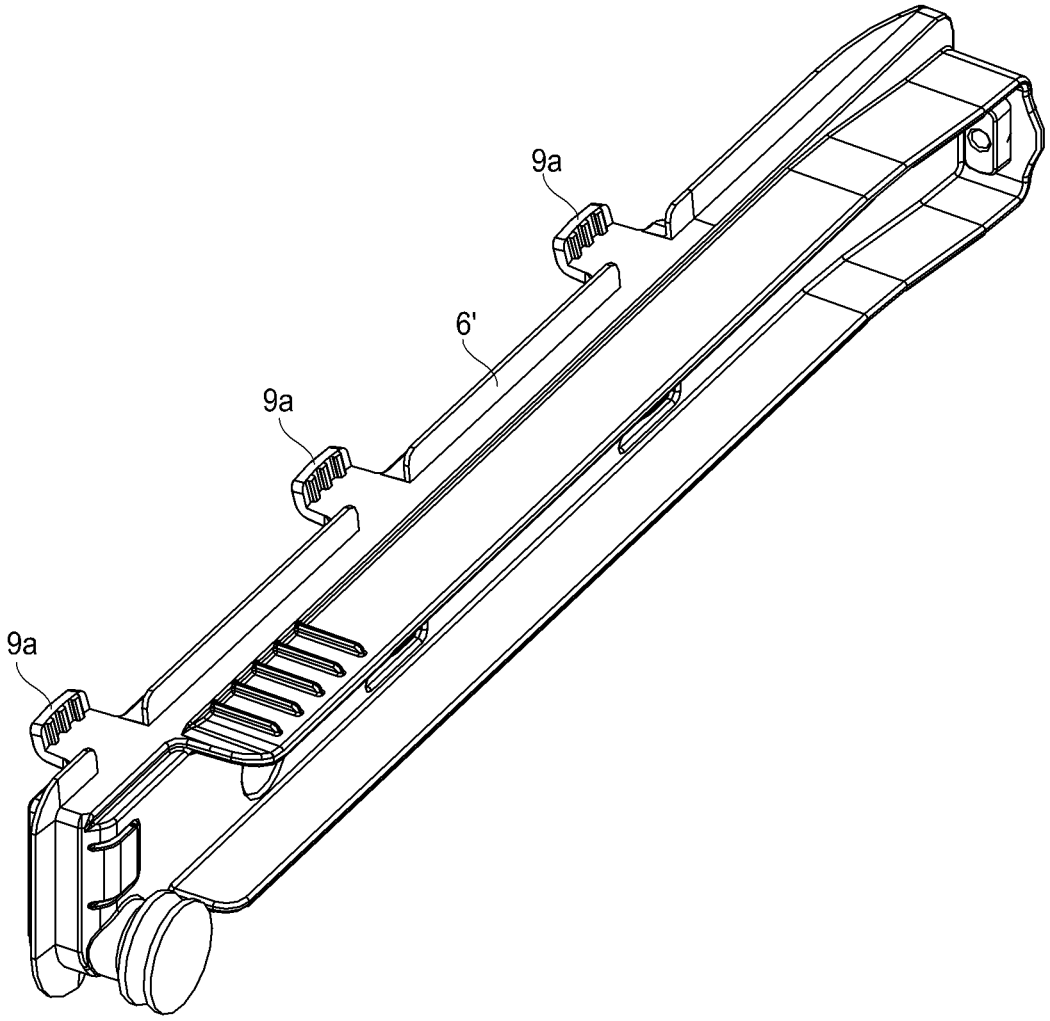
Figure 5:
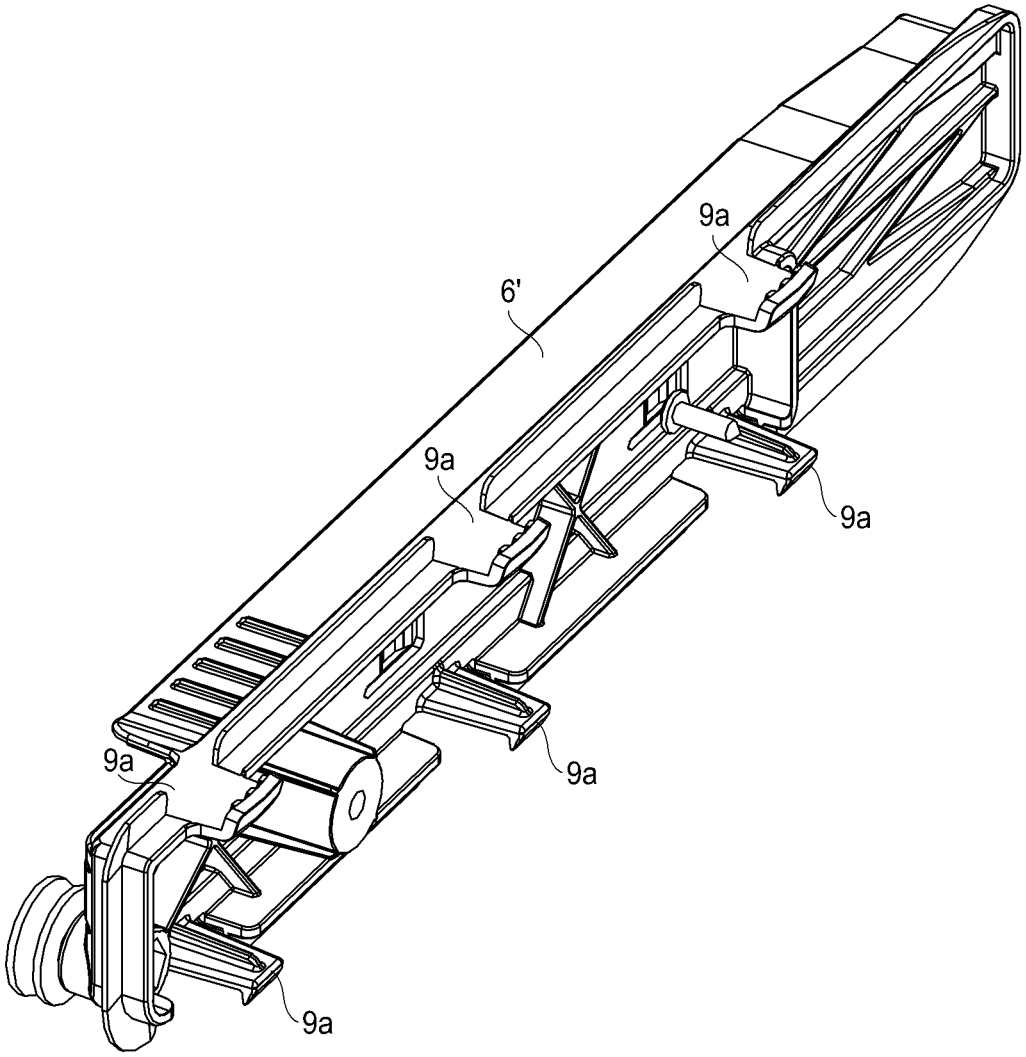
Figure 6:
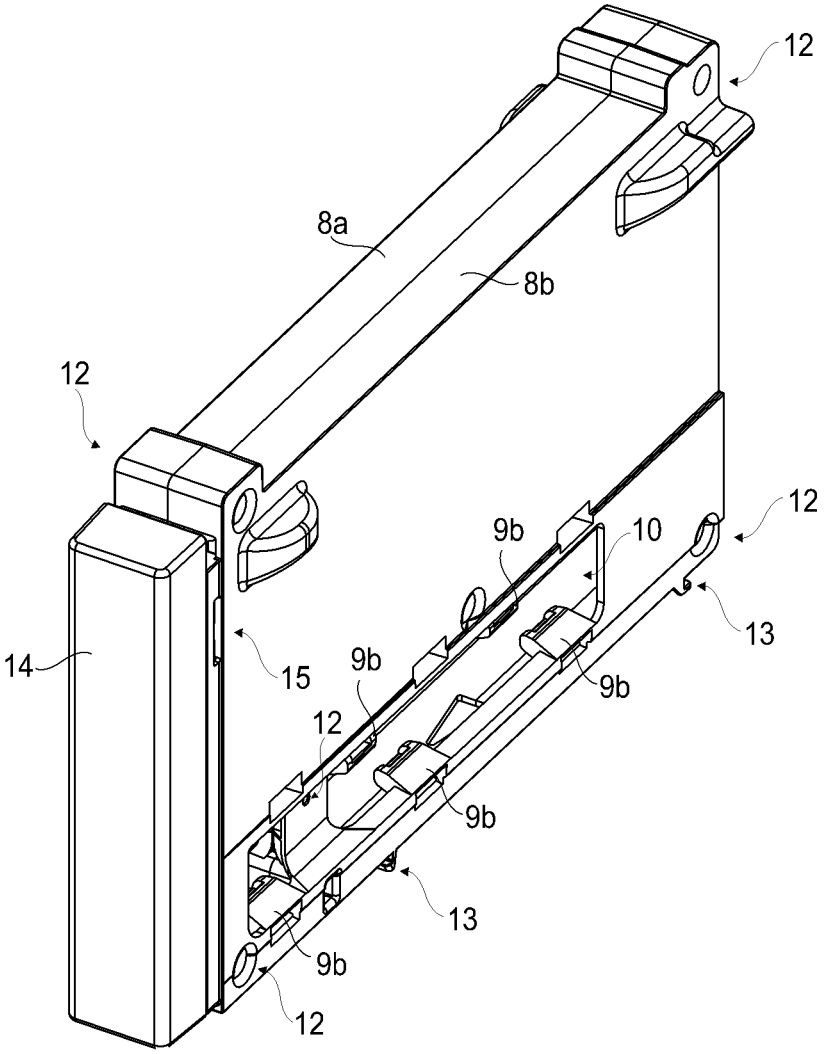
Figure 7:
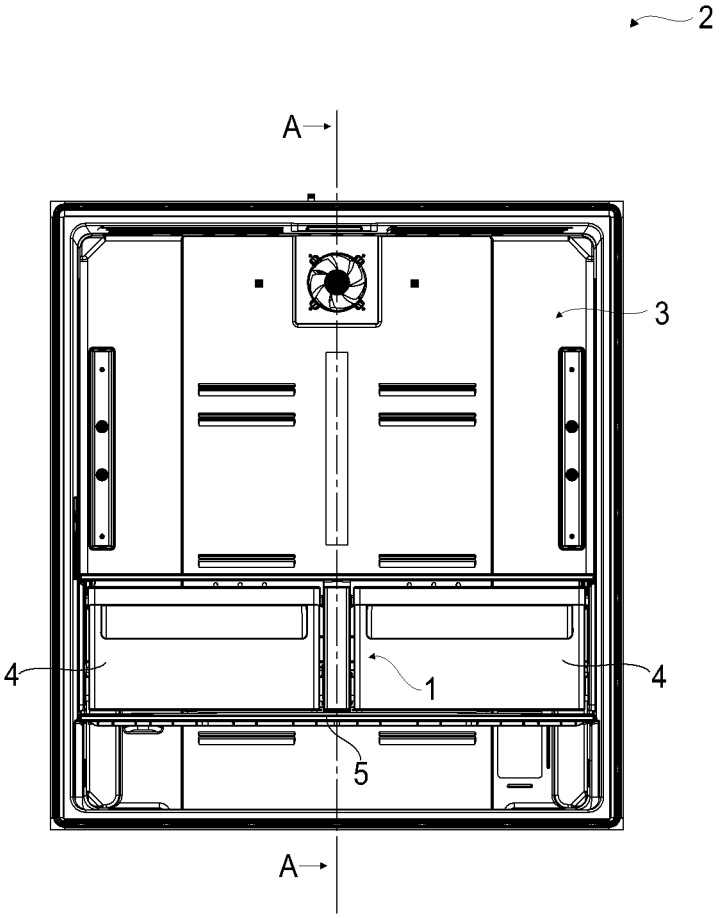
Figure 8:
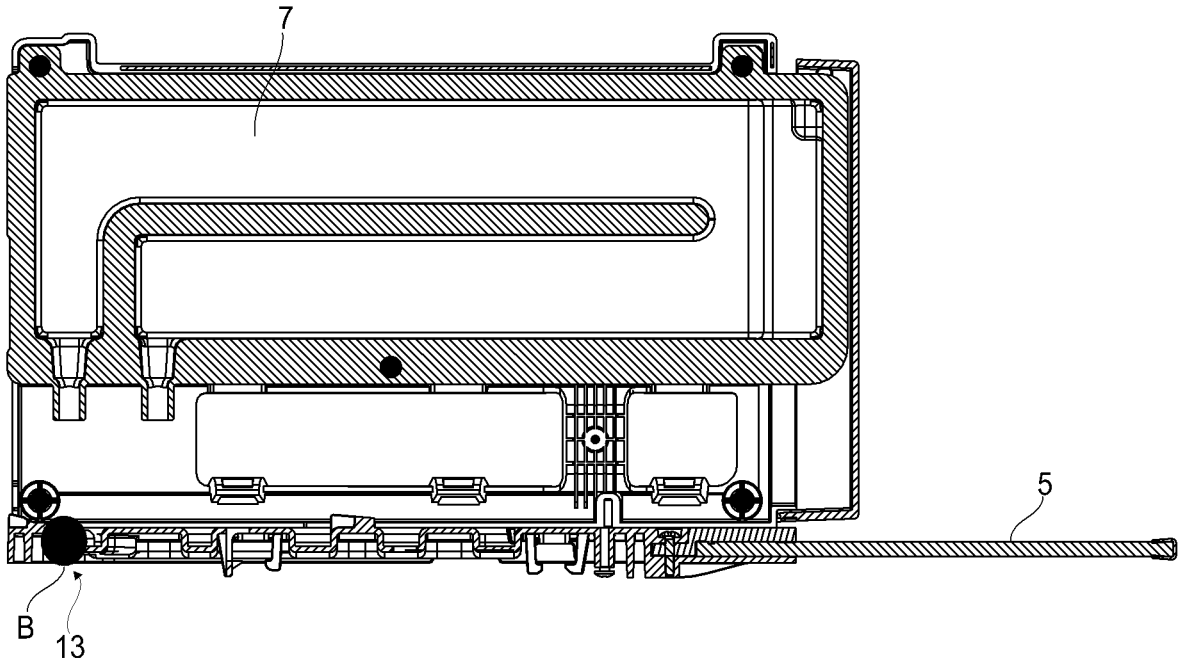
Figure 9:
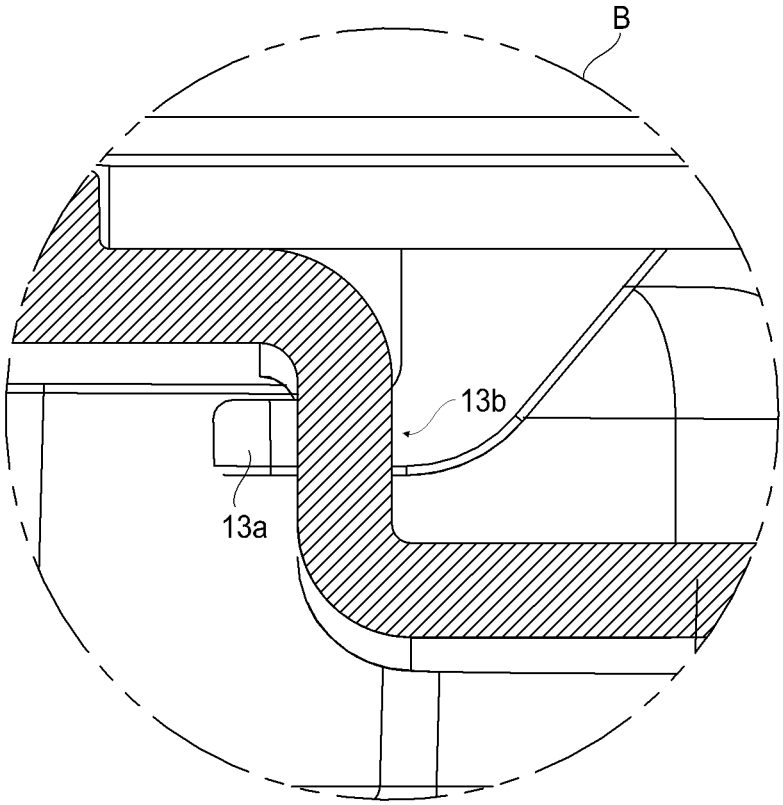
Figure 10:
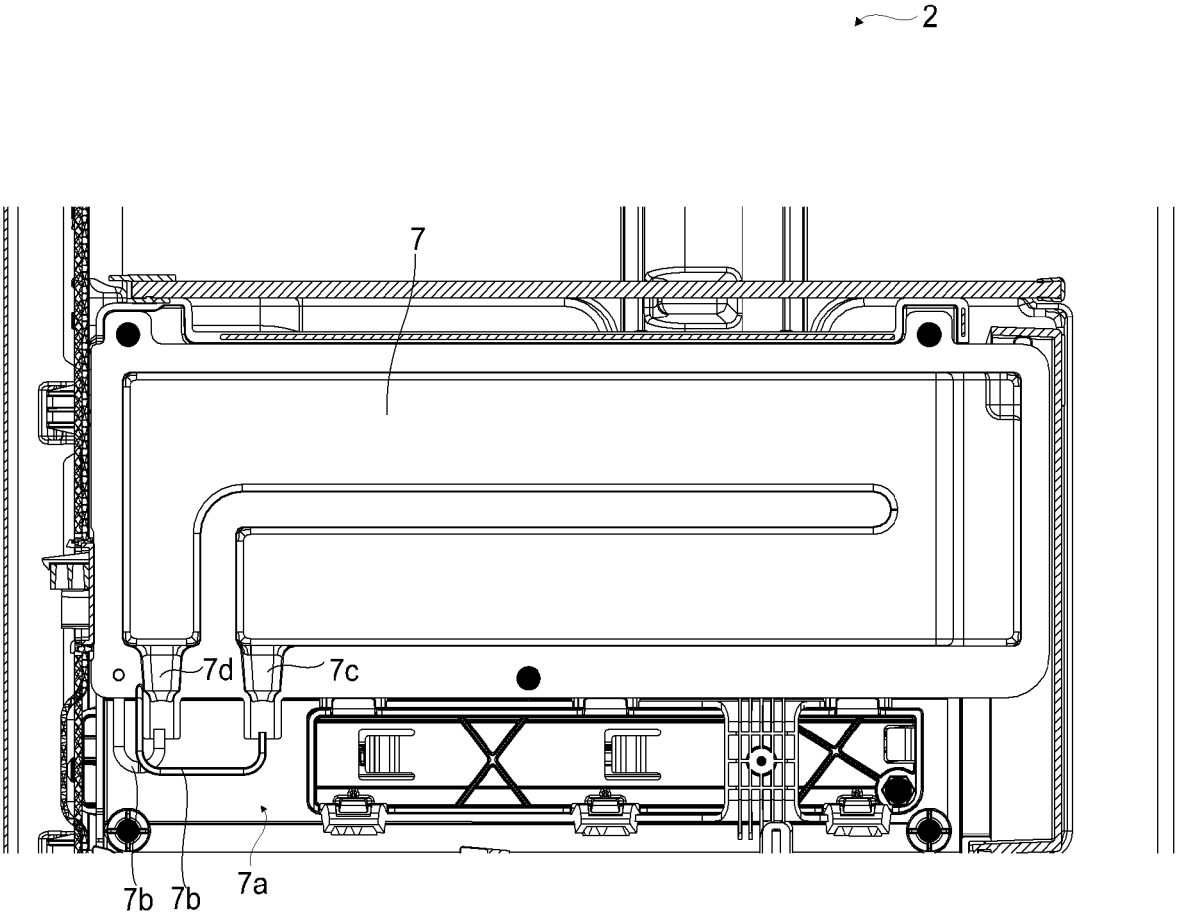

Additional features and additional advantageous effects of the water tank assembly and the refrigerator of the present invention will become more apparent with the detailed description of the embodiments with reference to the accompanying drawings in which:

FIG. 1—is a schematic partial perspective view of a refrigerator which has a water tank assembly according to an embodiment of the present invention;

FIG. 2—is a schematic exploded partial perspective view of the refrigerator of FIG. 1;

FIG. 3—is another schematic exploded partial perspective view of the refrigerator of FIG. 1;

FIG. 4—is a schematic enlarged perspective view of the inner guiding member of FIG. 3;

FIG. 5—is another schematic enlarged perspective view of the inner guiding member of FIG. 3;

FIG. 6—is a schematic enlarged partial perspective view of the water tank assembly of FIG. 1;

FIG. 7—is a schematic partial front view of the refrigerator of FIG. 1;

FIG. 8—is a schematic enlarged sectional partial view of the water tank assembly and the lower plate of FIG. 7, taken along the line A-A;

FIG. 9—is a schematic enlarged view of the detail B of FIG. 8;

FIG. 10—is a schematic enlarged sectional partial view of the refrigerator of FIG. 7, taken along the line A-A.

The reference signs appearing on the drawings relate to the following technical features.

1. Water tank assembly
2. Refrigerator
3. Compartment
4. Extendable drawer
5. Lower plate
6. Outer guiding member
6' Inner guiding member
7. Water tank
7*a*. Supply means
7*b*. Conduit
7*c*. Inlet
7*d*. Outlet
8. Casing
8*a*. Left side section
8*b*. Right side section
9. $1^{st}$ Attachment means
9*a*. Snap-in claw
9*b*. $1^{st}$ snap-in indent
10. Inner recess
11. Cavity
12. $2^{nd}$ Attachment means
12*a*. Screw hole
12*b*. Screw
13. $3^{rd}$ Attachment means
13*a*. Hook
13*b*. Hook hole
14. Decorative cover
15. $4^{th}$ Attachment means
16. Fastening means
16*a*. $2^{nd}$ snap-in indent
17. Side wall
18. Inner lining
19. Outer recess
20. Shelf The water tank assembly (1) is suitable for use in the refrigerator (2) (FIG. 1).

The refrigerator (2) comprises a compartment (3) for refrigerating the fresh food and a water dispenser (not shown) and/or an ice making apparatus (not shown).

The water tank assembly (1) comprises a water tank (7) which is adapted to replenish the water dispenser and/or the ice making apparatus of the refrigerator (2) (FIG. 2).

The refrigerator (2) of the present invention further comprises two extendable drawers (4) which are disposed side by side into the compartment (3), a lower plate (5) which is arranged underside of the extendable drawers (4), a first set of two outer guiding members (6) which are adapted to slidably support the extendable drawers (4) respectively from their outer sides, a pair of fastening means (16) each adapted to detachably attach one outer guiding member (6) to the respective side wall (17) of the compartment (3). In the refrigerator (2) of the present invention the region that is located above the lower plate (5) and in between the extendable drawers (4) is adapted for the installation of the water tank assembly (1) (FIGS. 1 to 3).

The water tank assembly (1) of the present invention comprises a casing (8) which is adapted for installation into the region between the extendable drawers (4) and onto the lower plate (5), wherein the water tank (7) is disposed into the casing (8); a second set of two inner guiding members (6') which are adapted to slidably support the extendable drawers (4) respectively from their inner sides, wherein the inner guiding members (6') are respectively identical to the outer guiding members (6) and a pair of first attachment means (9) each adapted to detachably attach one inner guiding member (6') to the respective side of the casing (8) (FIGS. 1 to 3).

In an embodiment, the water tank assembly (1) comprises two inner recesses (10) each adapted to accommodate one inner guiding member (6'). In this embodiment, the two inner recesses (10) are formed into the left side section (8*a*) and the right side section (8*b*) of the casing (8) respectively (FIG. 2 and FIG. 3).

In another embodiment, the first attachment means (9) comprises one or more snap-in claws (9*a*) and one or more first snap-in indents (9*b*) (FIGS. 4 to 6).

In another embodiment, the water tank assembly (1) comprises a cavity (11) which is adapted to accommodate the water tank (7). In this embodiment, the cavity (11) is formed into the casing (8) at a position above both inner recesses (10) (FIG. 2).

In another embodiment, the casing (8) comprises a second attachment means (12) which is adapted to attach the left side section (8*a*), the right side section (8*b*) and the water tank (7) together, wherein the left side section (8*a*) and the right side section (8*b*) jointly enclose the water tank (7) (FIG. 6).

In another embodiment, the second attachment means (12) comprises one or more screw holes (12*a*) and one or more screws (12*b*) (FIG. 2).

In another embodiment, the water tank assembly (1) comprises a third attachment means (13) which is adapted to detachably attach the casing (8) to the lower plate (5) (FIG. 8).

In another embodiment, the third attachment means (13) comprises one or more hooks (13*a*) and one or more hook holes (13*b*) (FIG. 9).

In another embodiment, the water tank assembly (1) comprises a decorative cover (14) which is adapted to conceal the front of the casing (8) and a fourth attachment means (15) which is adapted to detachably attach the decorative cover (14) to the the left side section (8*a*) and the right side section (8*b*) of the casing (8) (FIG. 6).

In another embodiment, the water tank assembly (1) further comprises an illuminating device (not shown). In this embodiment, the illuminating device is disposed onto the casing (8) so as to illuminate the adjacent extendable drawers (4).

In another embodiment, the water tank assembly (1) comprises a supply means (7*a*) which is adapted to connect the water tank (7) to the mains. In this embodiment, the supply means (7*a*) comprises conduits (7*b*) which are connected to the inlet (7*c*) and the outlet (7*d*) of the water tank (7) (FIG. 10).

In another embodiment, the refrigerator (2) comprises an inner lining (18) which defines the side walls (17) of the compartment (3) and two outer recesses (19) each adapted to accommodate one outer guiding member (6), wherein the two outer recesses (19) are formed into the opposite sides of the inner lining (18) respectively (FIG. 3).

In another embodiment, the fastening means (16) comprises one or more snap-in claws (9*a*) and one or more $2^{nd}$ snap-in indents (16*a*) (FIG. 1).

In another embodiment, the refrigerator (1) comprises a shelf (20) which is adapted to cover the area above extendable drawers (4), wherein the shelf (20) is releasably disposed into the compartment (3) (FIG. 3).

A major advantageous effect of the present invention is that the space utilization in the refrigerator (2) has been improved by way of installing the water tank assembly (1) into the region in between the extendable drawers (4) and onto the lower plate (5) (FIG. 1). Thereby, the dead space between the extendable drawers (4) has been effectively exploited. Another major advantageous effect of the present invention is that the functionality of the water tank assembly (1) has been improved by way of adapting the casing (8) so as to bear the adjacent extendable drawers (4) (FIG. 3). Another major advantageous effect of the present invention is that the outer/inner guiding members (6,6') of the extendable drawers (4) can be more flexibly used. In particular, the outer/inner guiding members (6,6') can be selectively attached to the side walls (17) of the compartment (3) or to the left/right side sections (8*a*, 8*b*) of the casing (8) during the assembly (FIG. 2). Thereby, the production and assembly costs can be further reduced. Other advantageous effects of the present invention can be taken from the above described embodiments.

The invention claimed is:

1. A refrigerator comprising:
- a compartment for refrigerating fresh food;
- a water dispenser and/or an ice making apparatus;
- two extendable drawers which are disposed side by side into the compartment;
- a lower plate which is arranged underside of the two extendable drawers,
- a set of two outer guiding members adapted to slidably support the two extendable drawers respectively from their outer sides, and
- a water tank assembly comprising:
  - a water tank which is adapted to replenish the water dispenser and/or the ice making apparatus;
  - a casing which is adapted for installation between the two extendable drawers and onto the lower plate, wherein the water tank is disposed into the casing,
  - a set of two inner guiding members adapted to slidably support the two extendable drawers respectively from their inner sides, wherein the set of two inner guiding members are respectively identical to the set of two outer guiding members, and
  - a pair of first attachment means each adapted to detachably attach one inner guiding member of the set of two inner guiding members to a side of the casing opposite from a side wall of an adjacent one of the two extendable drawers.

2. The refrigerator according to claim 1, further comprising two inner recesses each adapted to accommodate one inner guiding member, wherein the two inner recesses are formed into a left side section and a right side section of the casing respectively.

3. The refrigerator according to claim 2, further comprising a cavity which is adapted to accommodate the water tank, wherein the cavity is formed into the casing at a position above the two inner recesses.

4. The refrigerator according to claim 1, wherein the casing comprises a second attachment means which is adapted to attach a left side section, a right side section and the water tank together, wherein the left side section and the right side section of the casing jointly enclose the water tank.

5. The refrigerator according to claim 1, further comprising a third attachment means which is adapted to detachably attach the casing to the lower plate.

6. The refrigerator according to claim 1, further comprising a decorative cover which is adapted to conceal a front of the casing and a fourth attachment means which is adapted to detachably attach the decorative cover to a left side section and a right side section of the casing.

7. The refrigerator according to claim 1, further comprising a supply means which is adapted to connect the water tank to an external water source.

8. The refrigerator of claim 1, further comprising
- a pair of fastening means each adapted to detachably attach one outer guiding member to a respective side wall of the compartment, wherein the water tank is further adapted to replenish the water dispenser and/or the ice making apparatus.

9. The refrigerator according to claim 8, further comprising an inner lining which defines side walls of the compartment and two outer recesses each adapted to accommodate the one outer guiding member, wherein the two outer recesses are formed into the opposite sides of the inner lining respectively.

10. The refrigerator according to claim 8, further comprising a shelf which is adapted to cover an area above the two extendable drawers, wherein the shelf is releasably disposed into the compartment.

11. The refrigerator of claim 1, wherein the two extendable drawers are configured to slide over the set of two inner guiding members coupled to sides of the casing.

* * * * *